US005469411A

United States Patent [19]

Owen

[11] Patent Number: 5,469,411

[45] Date of Patent: Nov. 21, 1995

[54] METHOD AND APPARATUS FOR ACCURATE TIME MAINTENANCE AND DISPLAY

[75] Inventor: Jeffrey R. Owen, Portland, Oreg.

[73] Assignee: Seiko Communications Holding N.V., Netherlands

[21] Appl. No.: 236,534

[22] Filed: May 2, 1994

Related U.S. Application Data

[63] Continuation-in-part of Ser. No. 179,835, Jan. 7, 1994, Pat. No. 5,448,533, which is a continuation of Ser. No. 512,237, Apr. 18, 1990, abandoned.

[51] Int. Cl.[6] ..... G04C 11/00

[52] U.S. Cl. ..... 368/47

[58] Field of Search ..... 368/46–59

[56] References Cited

U.S. PATENT DOCUMENTS

| | | | |
|---|---|---|---|
| 4,322,831 | 3/1982 | Peterson | 368/46 |
| 4,415,271 | 11/1983 | Mori | 368/41 |
| 4,582,434 | 4/1986 | Plangger et al. | 368/46 |
| 4,607,257 | 8/1986 | Noguchi | 368/46 |
| 4,650,344 | 3/1987 | Allgaier et al. | 368/47 |
| 4,707,142 | 11/1987 | Baker et al. | 368/46 |
| 4,768,178 | 8/1988 | Conklin et al. | 368/47 |
| 4,823,328 | 4/1989 | Conklin et al. | 368/47 |

*Primary Examiner*—Bernard Roskoski
*Attorney, Agent, or Firm*—Elmer Galbi

[57] ABSTRACT

A time keeping and display system, device, and method are shown and illustrated including radio signal broadcast of a time of day reference signal. Remote time keeping devices intermittently collect the time of day reference. Each remote device automatically captures a current state of a time keeping counter when capturing the time of day reference. The captured state of the time keeping counter is later compared to the received time of day reference to calculate an update relative to the time of day counter. The calculated update may be a calculated error later applied as an offset to the counter, or may be a sum of the received time of day and an elapsed time, later loaded into the counter. When the remote device has no pending higher priority tasks, a brief fixed execution time procedure modifies the time keeping counter as a function of the calculated update. Because the process of modifying the time keeping counter is brief, no perceivable discontinuity in device operation, i.e., time display updates or response to user interface activity, occurs while the processing element of the device is dedicated entirely, i.e., interrupts disabled, to the task of modifying the content of the time keeping counter.

12 Claims, 5 Drawing Sheets

METHOD AND APPARATUS FOR ACCURATE TIME MAINTENANCE AND DISPLAY

RELATED APPLICATIONS

The present application is a continuation in part of U.S. patent application Ser. No. 08/179,835 filed by applicant herein Jan. 7, 1994 and entitled METHOD AND APPARATUS FOR ACCURATE TIME MAINTENANCE AND DISPLAY, the disclosure of which is incorporated herein fully by reference. The above-noted U.S. patent application Ser. No. 08/179,835 was filed as a file wrapper continuation of U.S. patent application Ser. No. 07/512,237 filed Apr. 18, 1990, now abandoned, by applicant herein and entitled METHOD AND APPARATUS FOR ACCURATE TIME MAINTENANCE AND DISPLAY. The above-noted U.S. Patent Applications are each assigned in common to the assignee of the present application.

FIELD OF THE INVENTION

The present invention relates generally to time keeping, and more particularly to a radio controlled time keeping apparatus.

BACKGROUND OF THE INVENTION

The present invention will be illustrated with reference to a paging system (the "Gaskill system") described in U.S. Pat. Nos. 4,713,808 and 4,897,835. However, it will be understood that the present invention is not limited to such context of use. The disclosures of U.S. Pat. Nos. 4,713,808 and 4,897,835 are incorporated herein by reference.

The Gaskill system incorporates paging devices into wristwatches. Paging information, together with high precision time of day information, is transmitted by FM radio signal to each paging device according to a time-multiplexed protocol. In accordance with this protocol, each paging device includes a timing mechanism activating a radio receiver and decoder of the watch-pager during a particular time slot. The watch-pager thereby activates its radio receiver and decoder to capture the radio signal data broadcast during a selected time slot.

In a conventional time piece, even the slightest inaccuracy in time keeping accumulates. The extent of error, i.e., deviation from a standard or common time reference, grows over time. For example, with a group of conventional digital display time pieces placed side by side, the least significant digits, e.g., the seconds digits, do not change in synchronization. Even if conventional time pieces are set initially to identical time, the slightest inaccuracy or relative inconsistency in time keeping accumulates and makes impossible synchronized time display for an extended period.

Time piece inaccuracy is observed, therefore, by inspecting the time display of a number of devices placed side by side. If the time pieces keep accurate time, simultaneous display updates by all time pieces will endure. For example, the seconds display for all devices change simultaneously. Typically, however, such simultaneous display updating is not achieved, and if achieved does not endure.

In a digital time piece in the form of a wristwatch, a processing unit manages such operations as extracting time of day information from a counter register and maintaining or updating a display synchronously at, for example, whole second intervals, i.e., the least significant display digit changes precisely at given intervals. A conventional time piece operating in this fashion dedicates entirely the processor resources to the simple task of retrieving time of day information from a counter register and updating the display and rarely the operation of user buttons to set time, activate a light, etc.

In a paging device incorporating a time piece and time display, however, the processing unit must also devote its processing resources to the significant tasks of managing incoming paging messages and related decoding, error checking, and frequent user interaction in displaying received paging messages. Accordingly, the time display function in such a paging device must share processor resources with the paging message receiving and processing functions. Unfortunately, this shared processing resource is necessarily limited in its processing power. Generally, processing elements available for use in such devices, i.e., a paging device incorporated into a small product such as a wristwatch, is a relatively weak processing element in its data width, clock speed and power consumption. While much more powerful processing elements, e.g., desktop personal computers, could more easily orchestrate the tasks of time maintenance and display and paging message processing and display, the processing element required in a small device such as a watch-pager device is challenged when faced with the combined tasks of time maintenance and display, paging message processing and display, and user interface support. Accordingly, such processing element may be incapable of providing synchronous time display updates relative to other similar time pieces, i.e., a group of such devices placed side by side would likely have non-synchronous transition in the seconds digit of the time display.

As may be appreciated, a paging device operating under a time multiplexed protocol and standing ready to interact with a user operating control buttons must timely react to interrupts generated by such activity. Such interrupt handling routines, however, can take enough processing time to affect time display updates. In other words, the processor may potentially be interrupted and unavailable at a time when the time display should be updated. As a result, time display updates may not always occur precisely at whole second intervals. To maintain display updates synchronously within human perception, the display updates must occur within a given time interval relative to one another. For example, human perception can detect time display updates offset by as much as one-tenth of a second. In a weak processing element managing both paging functions and time maintenance and display functions the time display function can be perceivably delayed, i.e., delayed by as much as or more than one-tenth of a second.

A paging device including time keeping and display functions desirably provides accurate time display wherein a group of such devices exhibits such accuracy by continued simultaneous time display updating. The subject matter of the present invention provides such a time display update capability.

SUMMARY OF THE INVENTION

A highly accurate time keeping device and time keeping system includes a plurality of watches maintaining exact synchronization in time maintenance and display over an extended period. With the present invention, time of day data is periodically received by, for example, a wristwatch via radio signal and the time display maintained by the watch under the present invention exhibits, within a range of human perception, synchronous display transitions and immediate response to user interface activity.

A time keeping and display system according to the present invention includes a time of day broadcast device providing a time of day reference signal. A remote time keeping and display device receives intermittently the time of day reference and includes a time keeping element maintaining a time of day. A latch of the time keeping and display element captures automatically a time of day value from the time keeping element in response to said time keeping and display element receiving said time of day reference. A processing element then calculates a time of day error as a function of said captured time of day value and said time of day reference. The processing element may then later modify the time keeping element to adjust for the calculated error during a short fixed execution time procedure. Because the execution time is fixed and may be made minimally short, no perceivable loss of synchronization results in time display updates or device operation during an interval in which the processing element is dedicated entirely to updating the time keeping element.

The subject matter of the present invention is particularly pointed out and distinctly claimed in the concluding portion of this specification. However, both the organization and method of operation of the invention, together with further advantages and objects thereof, may be best understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
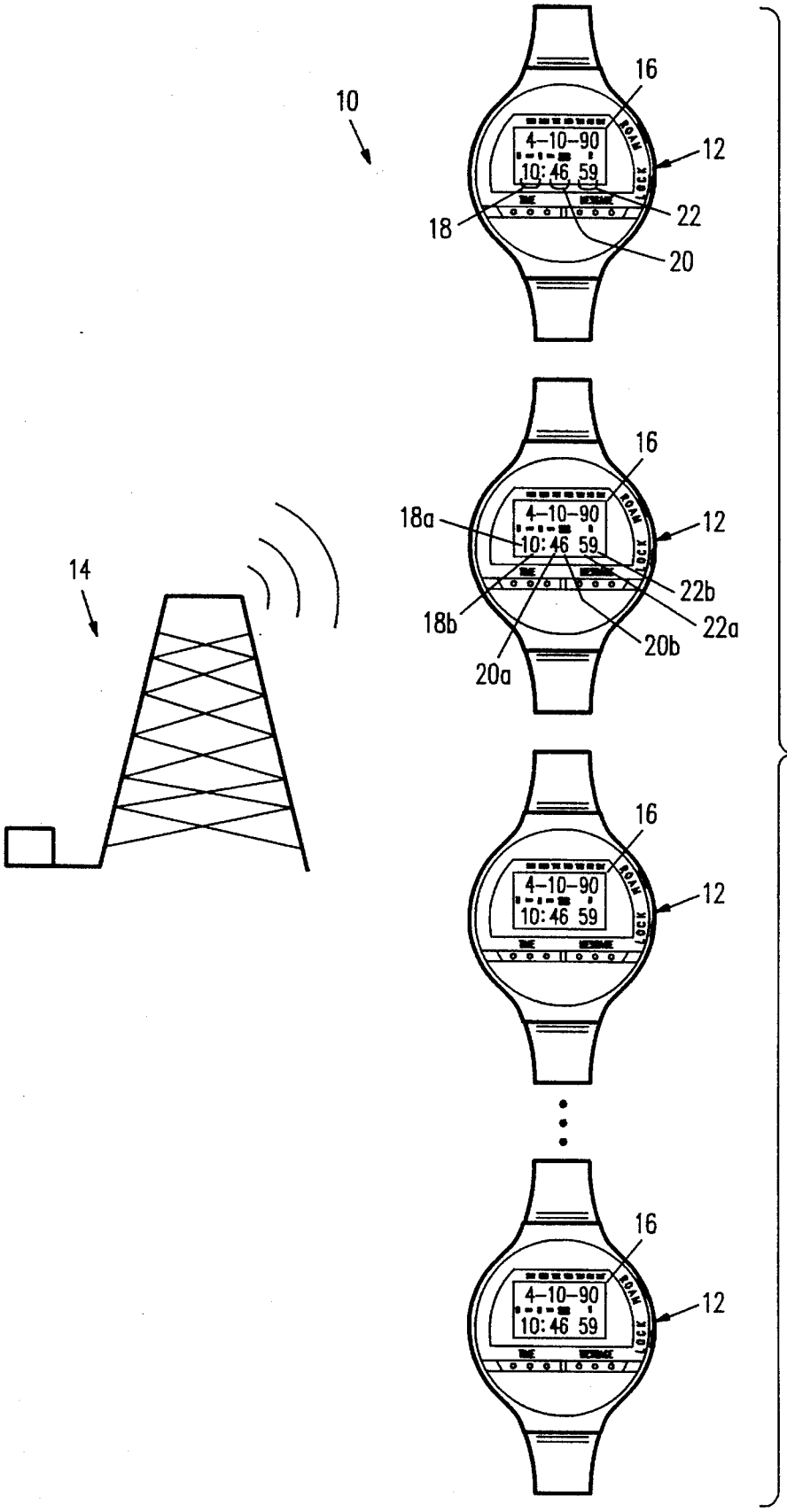
FIG. 1 illustrates a communications system including a plurality of wristwatch-paging devices, each maintaining and displaying a time of day, and a radio broadcasting device providing by radio signal time of day data to the wristwatch-paging devices.

In FIG. 1, a time keeping system 10 includes a radio signal broadcasting device 14 and a plurality of wristwatch devices 12. The time keeping system 10 illustrated is integrated into the Gaskill paging system described in U.S. Pat. Nos. 4,713,808 and 4,897,835.

In the Gaskill paging system, radio signal broadcasting device 14 provides paging information to devices 12 in accordance with a time slot protocol. Each wristwatch device 12 is associated with one or more time slots in a repeating sequence of time slots. A data packet is broadcast during each time slot. Each device 12 activates during its associated time slot, or slots, and receives paging information directed to it. Radio signal broadcasting device 14 also provides current time of day data to provide the ability of the wristwatch to automatically adjust its time of day to reflect movement between time zones or advent of day light savings time. This time of day data is used to periodically set the wristwatches devices 12 to the current time of day. Thus, all devices 12 receiving radio signals provided by broadcast device 14 are periodically set relative to a common time standard. Between such periodic setting of devices 12, each device 12 accurately maintains time to synchronously activate for a next associated time slot and to accurately display the time of day.

As used herein, and in the claims appended hereto, the term "time of day data" shall mean information referencing a time standard. For example, broadcasting device 14 broadcasts in certain data packets a set of time of day values, e.g., hours, minutes, seconds, and fractions of a second. Upon capture of the data packet, a current time of day coincident with capture of the packet may be defined relative to the time of day values found in the data packet, perhaps offset by a known factor taking into account fixed delays associated with bundling the data packet, transmitting the packet, and receiving the packet. Alternately, each data packet carries a time slot identification field uniquely identifying the time slot within the repeating cycle of time slots. By capturing an arbitrary data packet, it is, therefore, possible to reference a time standard by identifying the associated time slot within the repeating cycle of time slots. A time of day may, therefore, be derived by use of the time slot identification field with knowledge of protocol organization. In any case, each wristwatch device 12, when using such time of day data taken from a captured data packet, references a common external time standard.

Each wristwatch device 12 of time keeping system 10 includes a display 16 presenting a current time of day. It will be appreciated that the time keeping accuracy of system 10 is exemplified by each display 16 not only presenting an identical time of day, but also by displays 16 changing simultaneously from one time of day display to the next for extended period of time.

Each device 12 presents the current time of day as a sequence of ordered digit pairs 18, 20, and 22 representing hours, minutes and seconds, respectively. Each of digit pairs 18, 20 and 22 include a high order tens digit indicated herein by a reference numeral suffix "a." Similarly, each of the digit pairs 18, 20, and 22 include a lower order units digit indicated herein by a reference numeral suffix "b." As may be appreciated, the seconds digit **22*b* changes most frequently, and the remaining digits are changed as necessary to indicate a sequence of time display, i.e., when the seconds digit 22*b* changes from "9" to a "0" the seconds digit 22*a* increments along with any other higher order digits as may be required. Accuracy of time keeping system 10 is reflected generally by identical digit pairs 18, 20 and 22 on each display 16, and particularly by simultaneous change, within human perception, in the digit 22*b* for all wristwatch devices 12**.

Figure 2:
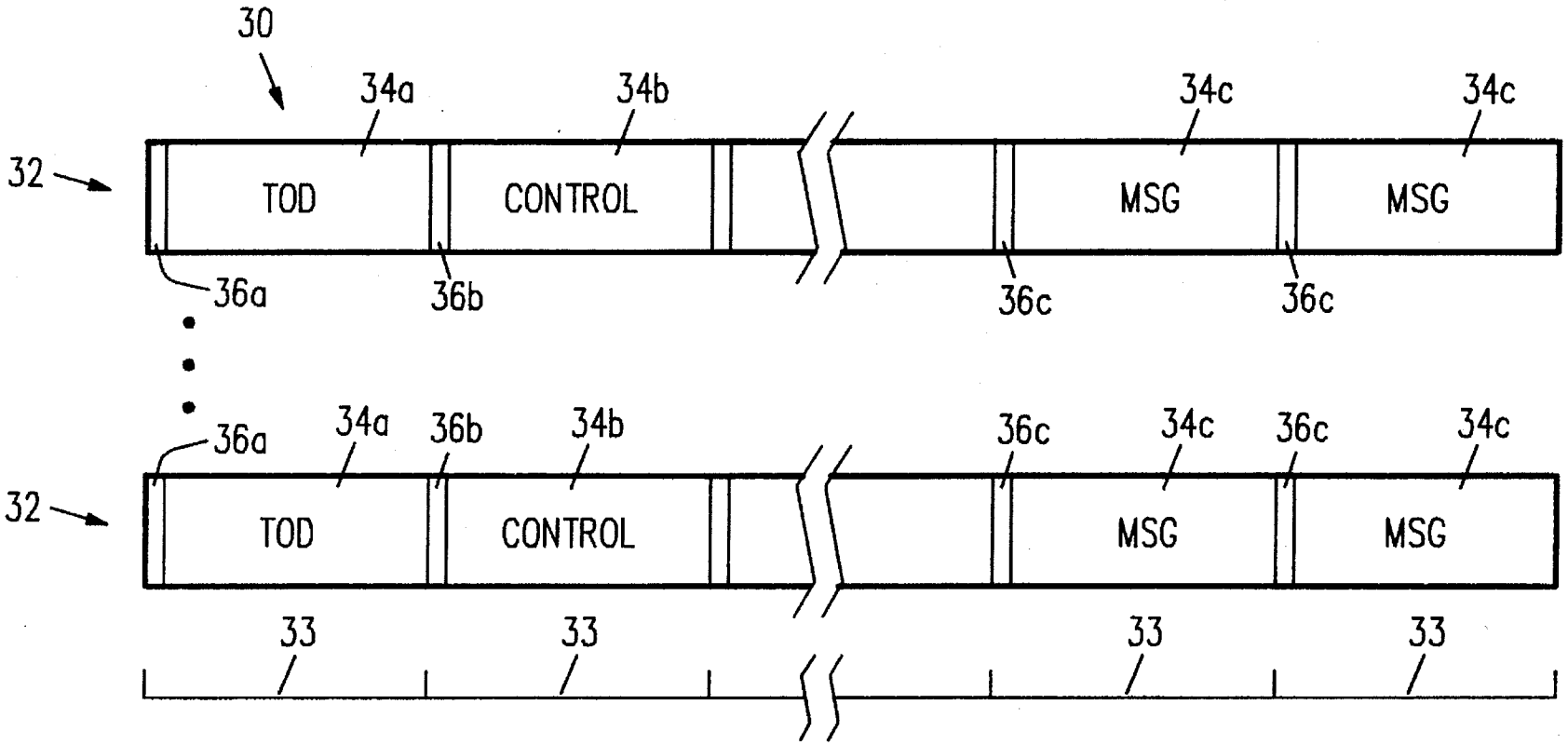
FIG. 2 illustrates in simplified form a time-multiplexed protocol employed in the communication system of FIG. 1.

FIG. 2 is a simplified illustration of the time slot protocol of the Gaskill system. In FIG. 2, a repeating time frame 30 includes a set of subframes 32. Each subframe 32 includes a sequence of time slots 33. During each time slot 33, a packet delineation flag 36 and corresponding data packet 34 are transmitted by broadcast device 14 for capture by devices 12. The data packets 34 may include a variety of information in support of the broadcast protocol, but the majority of such data packets 34 are paging message packets 34*c* directed to selected ones of the devices 12. Current time of day data, however, is found in the leading time slot 33 of each subframe 32. In particular, a time of day packet 34*a* may be collected by each device 12 by targeting a leading time slot of one of the subframes 32. Control data packets 34*b*, illustrated herein at the second time slot 33 in each subframe 32, may contain other information in support of the broadcast protocol, e.g., a radio frequency list for tuning to a set of local radio broadcast devices 14.

During the other time slots 33 of time frame 30, message packets 34*c* are broadcast and collected by devices 12 associated therewith. Each device 12 targets a selected one of the remaining time slots 33, i.e., one associated therewith, in pursuit of message packets 34*c* directed thereto.

Each of devices 12 may, when necessary, target for capture one of the data packets 34*a* or 34*b*. In particular, and as relevant to the present discussion, devices 12 intermittently target one of the data packets 34*a* to update an internal or local time keeping circuit and thereby maintain synchronization with the time frame 30. It will be understood that the time of day information available in data packets 34*a* is of high precision, i.e., not only hours, minutes, and seconds but also fractions of a second to a given number of decimal points of precision.

Each data packet 34 is delineated from adjacent data packets 34 by a flag field 36 of given value. In capturing data during a given time slot 33, each device 12 begins data capture slightly before the targeted time slot 33 and continues data capture just beyond the targeted time slot 33. The flag field 36 allows each device 12 to identify the data packet 34 within the captured data. Furthermore, the flag field 36*a* represents a point of reference for the time of day data packets 34*a*. More particularly, the point in time at which a device 12 detects capture of a flag 36*a* may be correlated with the time of day values in the data packet 34*a*. For the present discussion, it will be understood that the time of day values presented in a data packet 34*a* represent the time of day coincident with device 12 detection of the associated flag field 36*a*. As may be appreciated, however, the relationship between the time of day values presented in data packet 34*a* and the time of detecting capture of the associated flag field 36*a* may be offset by a fixed amount, e.g., as a result of preparing, transmitting and receiving the data packets 34 under the time-multiplexed broadcast protocol. As taken herein, however, the time of day values presented in field 34*a* shall be assumed to be accurate as of the time of device 12 detecting the associated flag field 36*a*.

Figure 3:
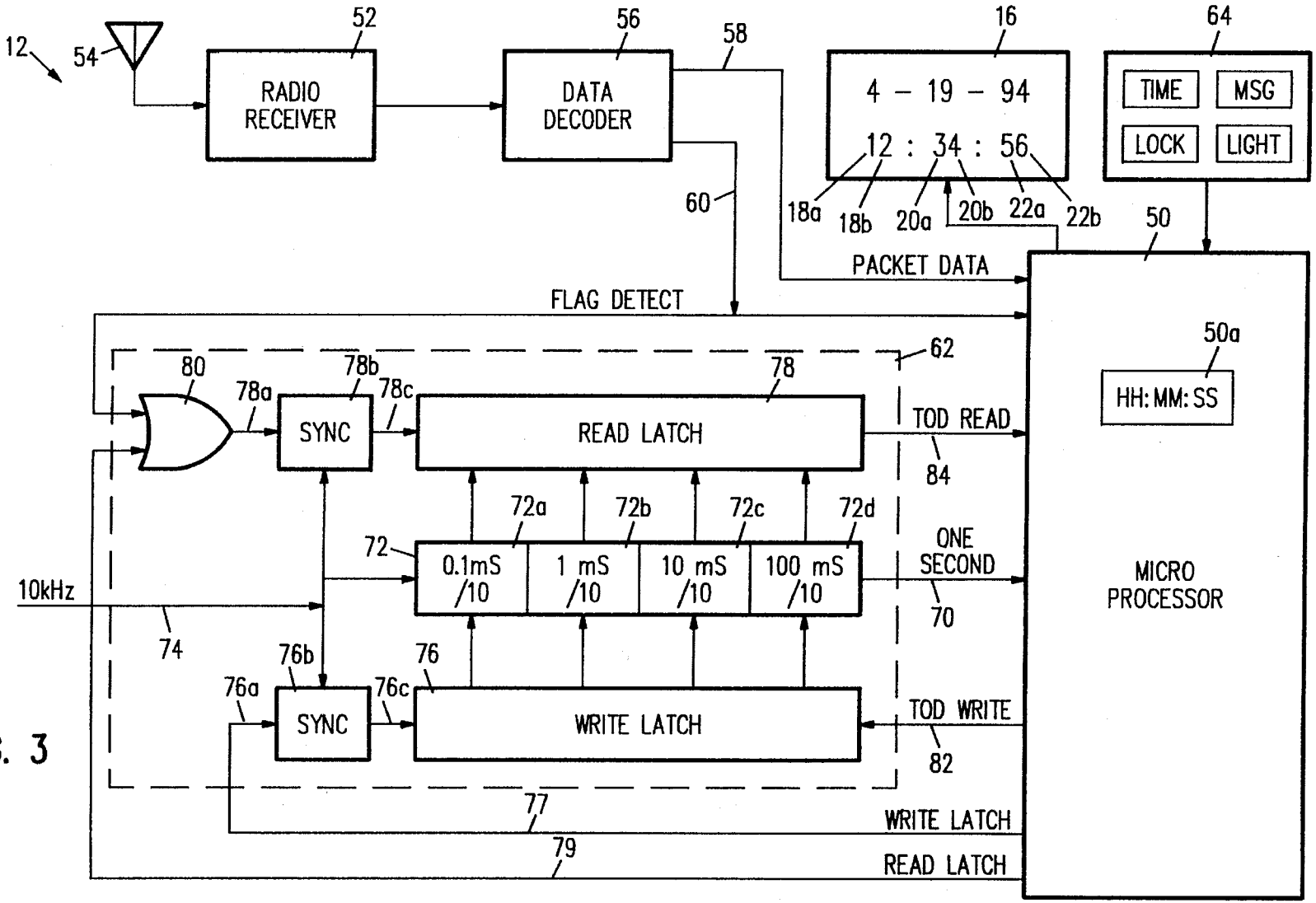
FIG. 3 is a block diagram a wristwatch-paging device of FIG. 1 and components thereof supporting accurate time maintenance and display under the present invention.

FIG. 3 illustrates generally the architecture of each device 12, and particularly components thereof dedicated to time maintenance under the present invention. In FIG. 3, each device 12 includes a microprocessor 50 driving the associated display 16. Each device 12 further includes a radio receiver 52 receiving by way of antenna 54 data provided by broadcast device 14. Receiver 52 delivers a demodulated signal to a data decoder 56. Decoder 56 provides a variety of functions including error correction and isolating message data by identifying the flag field 36 within each block of collected data. Accordingly, decoder 56 delivers packet data 58 corresponding to content of a captured data packet 34 to microprocessor 50. Decoder 56 also generates a flag detect signal 60 delivered to microprocessor 50, and also to a second counter 62 described more fully hereafter.

Microprocessor 50 must orchestrate the targeting of a selected time slot 33 and collection of message data 58 in coordination with processing interrupts from second counter 62. Furthermore, microprocessor 50 must respond to user activity generated by operation of input buttons, illustrated collectively in FIG. 3 at reference numeral 64. Such user activity may include a variety of user initiated functions such as review of stored paging messages and display of various status information relating to operation of device 12.

The second counter 62 provides a transition in a one second signal 70 at each whole second interval. A transition in signal 70 triggers an interrupt procedure of microprocessor 50 to modify the time display presented on display 16, i.e., increment the seconds unit digit 22*b* and any other higher order digits requiring increment as a result thereof. Microprocessor 50 includes, therefore, internal memory registers 50*a* for storing current time of day, including hours, minutes, and seconds, and employs such registers 50*a* in driving display 16. The second counter 62 as illustrated herein provides a basis for incrementing the values in internal registers 50*a* according to a time standard.

The second counter 62 includes a ripple counter 72 generating the one second signal 70, e.g., the one second signal 70 representing an overflow condition of ripple counter 72. A ten KHz clock signal 74 drives ripple counter 72. Ripple counter 72 includes a series of binary coded decimal (BCD) digits, individually represented herein as digits 72*a*–72*d*. As may be appreciated, however, counter 72 may provide any number of digits at any given degree of resolution. Counter 72 thereby responds to the clock signal 74 and increments in cascade fashion the digits 72*a*–72*d* and, when a whole second interval occurs, generates a transition in the one second signal 70 presented to microprocessor 50.

The second counter 62 further includes a write latch 76 and a read latch 78. Each of latches 76 and 78 include binary coded decimal digits corresponding to the digits 72*a*–72*d* of ripple counter 72. Accordingly, the content of write latch 76 may be loaded into ripple counter 72 in parallel fashion by assertion of a latch signal 76*a*. A write latch signal 77 originating from microprocessor 50 provides the latch signal 76*a* to write latch 76 as described hereafter. Similarly, the content of ripple counter 72 may be captured in parallel fashion into read latch 78 by assertion of a latch signal 78*a*. Latch signal 78*a* may originate from microprocessor 50, or may originate from decoder 56 in response to the flag detect signal 60. Accordingly, an OR gate 80 provides at its output the latch signal 78*a* and receives at one input the flag detect signal 60 from decoder 56 and at another input a read latch signal 79 from microprocessor 50.

A synchronization block 76*b* receives the 10 KHz clock signal 74 and applies a latch control signal 76*c* to write latch 76. Similarly, a synchronization block 78*b* also couples to the 10 KHz clock signal 74 and applies a control signal 78*c* to read latch 78. Synchronization blocks 76*b* and 78*b* coordinate the loading of information into and taking of information out of the ripple counter 72 in coordination with state transitions thereof. In this manner, data is not taken from or placed into ripple counter 72 during an intermediate or indeterminate state affecting the validity of such data transfer.

Microprocessor 50 loads fractional second time of day (TOD) write data 82 into write latch 76 and collects fractional second TOD read data 84 from read latch 78. Microprocessor 50 thereby asserts a set of digits 72*a*–72*d* into ripple counter 72 by way of TOD write data 82 and write latch 76; and collects the content of ripple counter 72 at a given point in time by way of read latch 78 and TOD read data 84.

Figure 4:
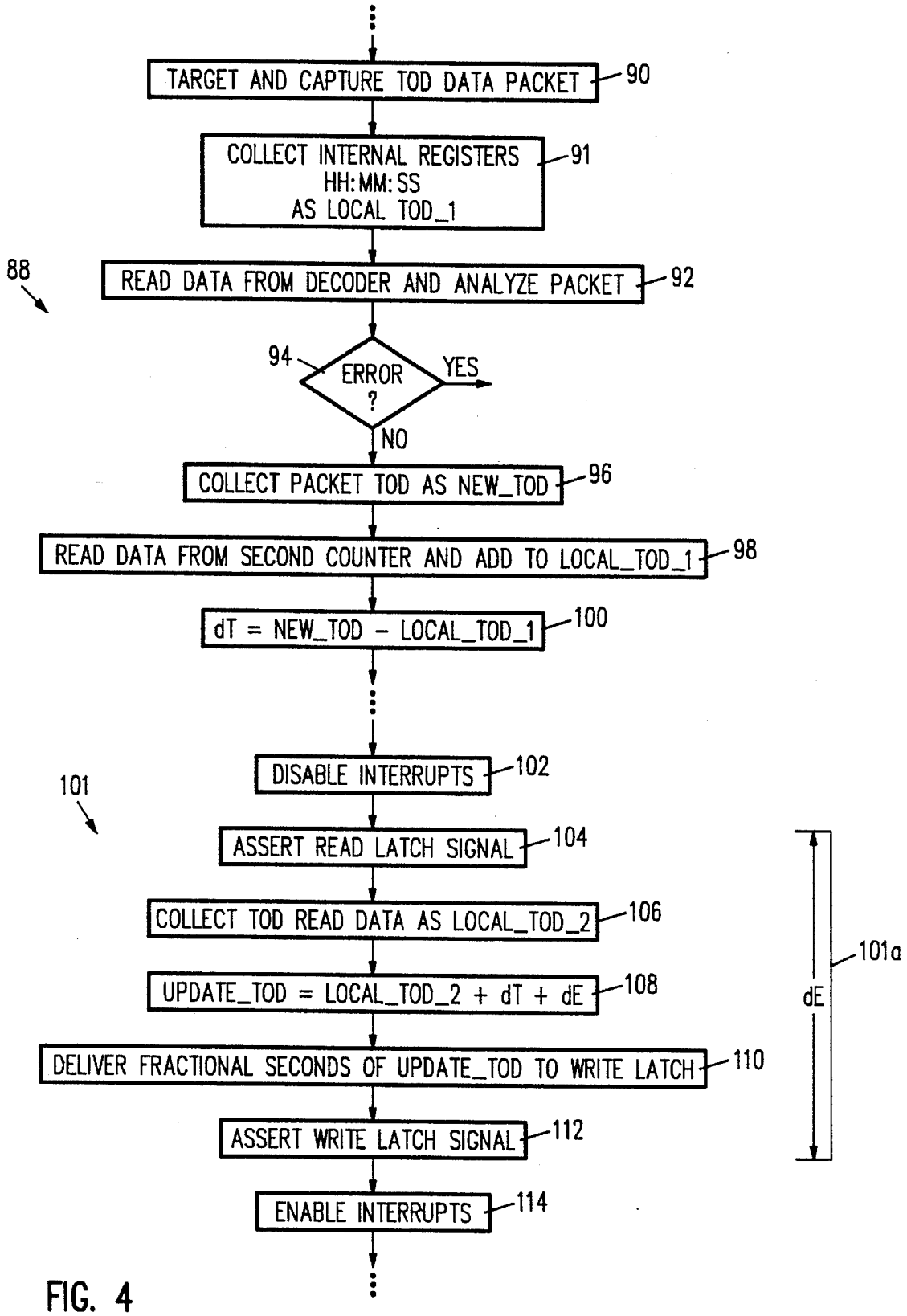
FIG. 4 is a flow chart illustrating operation of a processor element of FIG. 3 in implementation of the present invention.

FIG. 4 illustrates a first embodiment of programming and operation of microprocessor 50 when seeking time of day data from one of data packets 34*a*. Programming of FIG. 4 includes a first programming segment 88 and a second programming segment 101, with other programming tasks allowed therebetween and the programming segment 88 being generally interruptible, e.g., microprocessor 50 standing ready to service user activity at the buttons 64. Programming segment 101, however, includes a brief sub-segment 101*a* executed with interrupts disabled and having a known and fixed execution time dE. Such programming segments 88 and 101 execute intermittently to provide each device 12 with a current time of day reference. Thus, even though each device 12 may be challenged to maintain absolute synchronous display updates for extended periods of time, by intermittently updating relative to a common time standard the time offset between display updates of similar devices 12 is small enough to be imperceivable, and therefore may be taken as highly accurate by the users of devices 12.

In FIG. 4, processing begins in block 90 where device 12 targets and captures a time of day data packet 34*a*. Important to note, during operation of block 90 the decoder 56 asserts the flag detect signal 60. In response to the flag detect signal 60, i.e., as applied to OR gate 80, second counter 62 latches the current content of ripple counter 72 into read latch 78. Thus, read latch 78 holds a time of day fractional second value held by device 12 at the time of the assertion of the flag detect signal 60 for the captured time of day data packet 34*a*. Flag detect signal 60 also interrupts microprocessor 50 causing entry into block 91 wherein the current content of internal registers 50*a*, i.e., hours, minutes, and seconds, is collected as the variable LOCAL_TOD_1. The flag detect signal 60 also alerts microprocessor 50 that a packet is being held in decoder 56 and requires collection as packet data 58. Block 92 represents activity of reading the packet data 58 from the decoder 56 and analyzing its content by microprocessor 50. Important to note, processing in block 92 takes a relatively long time, i.e., within the realm of human perception, and must be an interruptible procedure, i.e., the processor 50 must stand ready to service any user activity in manipulation of buttons 64.

Decision block 94 represents an error condition detected by either decoder 56 or microprocessor 50. The NO branch from decision block 94 represents a path taken when a valid time of day data packet 34*a* has been successfully captured and delivered from decoder 56 to microprocessor 50 as the packet data 58.

Thus, when decoder 56 asserts the flag detect signal 60, the read latch 78 receives the fractional second portion of the current local representation of time of day as provided by ripple counter 72. Because the time of day values held in the collected time of day data packet 34*a* are defined relative to the time of detecting the flag 36*a* (FIG. 2) of the corresponding data packet 34*a*, device 12 has a basis for calculating the magnitude of error in the ripple counter 72, i.e., can compare the content of read latch 78 with the fractional second portion of time of day values of the collected time of day data packet 34*a*.

Continuing to block 96, device 12 extracts the time of day values presented in the collected data packet 34*a* and assigns such values to the variable NEW_TOD. In block 98, device 12 collects TOD read data 84 from read latch 78 and adds it to the variable LOCAL_TOD_1. In block 100, device 12 calculates a magnitude of error. In particular, the variable dT receives the result of LOCAL_TOD_1 subtracted from NEW_TOD. The variable dT is then stored in microprocessor 50 memory, for later use in offsetting the content of ripple counter 72 and registers 50*a* to correct for the detected magnitude of error.

Device 12 has the opportunity throughout the above programming segment 88 to conduct other processing tasks, e.g., by interrupt, which may have relatively higher priority as compared to updating the content of ripple counter 72 and registers 50*a*. At a later time, however, when no higher priority activity is pending then processing advances to programming segment 101 having therein the sub-segment 101*a* of constant execution time dE. Programming sub-segment 101*a* is a brief, fixed execution time procedure wherein microprocessor 50 interrupts are disabled and the ripple counter 72 modified as a function of the detected magnitude of error therein, i.e., offset by the factor of error represented by the fractional second portion of variable dT.

In block 102 device 12 disables microprocessor 50 interrupts. In block 104, microprocessor 50 asserts the read latch signal 79, defining the beginning of sub-segment 101*a*, to collect from ripple counter 72 its current content into the read latch 78. In block 106, microprocessor 50 collects from read latch 78 the fractional second time of day read data 84 as the variable LOCAL_TOD_2. Continuing to block 108, microprocessor 50 calculates a new value to be loaded into ripple counter 72. In particular, the variable UPDATE_TOD receives the sum of the variables LOCAL_TOD_2 and dT and also the constant dE. Then, in block 110, microprocessor 50 loads the write latch 76 with the fractional second portion of variable UPDATE_TOD. In the terminal step of program sub-segment 101*a*, microprocessor 50 asserts the write latch signal 77 causing write latch 76 to load in parallel its content into the ripple counter 72. In this manner, ripple counter 72 receives an accurate fractional second time of day representation taking into account the detected error relative to the collected time of day data packet 34*a* and the processing time required, i.e., the constant dE, the time between asserting the read latch in block 104 and asserting the write latch in block 112. Following block 112, microprocessor 50 enables interrupts in block 114.

As may be appreciated, microprocessor 50 may be required to also offset the content of internal registers 50*a*. More particularly, the variable dT represents a magnitude of error without limitation, i.e., may be anywhere within a range of fractions of a second to hours. For example, if the device 12 is out of range of the paging system for extended time or if the user mistakenly resets device 12 time, its local time of day representation in registers 50*a* could differ significantly from the paging system time of day reference. Once the device 12 is brought back into range of the paging system, programming segment 88 calculates a magnitude of error as the variable dT representing whatever offset then exists between the local time of day held by device 12 and that presented in the captured time of day packet 34*a*.

Accordingly, in programming segment 101 calculation of the variable UPDATE_TOD, incorporating the value of the variable dT, could potentially be greater than one second. The fractional portion of the variable UPDATE_TOD is placed in ripple counter 72 during execution of programming segment 101. If the variable UPDATE_TOD is of magnitude greater than one second, microprocessor 50 must also offset the internal registers 50*a* according to the non-fractional portion of variable UPDATE_TOD. Such modification, therefore, requires reading of the internal registers 50*a*, offsetting that value according to the sign and magnitude of the hours, minutes, and seconds portion of the variable UPDATE_TOD, and writing the new value back into registers 50*a*.

An important aspect of a personal electronic device such as a combined pager wristwatch device is prompt and consistent response to user button activity. As may be appreciated, microprocessor 50 in orchestrating such activity may be burdened under strict criteria of user interface reaction times and synchronous time display. For example, the device should promptly respond to user activity, i.e., no perceivable delay between a time of pressing a button 64 and the corresponding device 12 response. When executing a fixed execution time segment, i.e., such as illustrated in FIG. 4, total execution time must be small enough to allow for disablement of interrupts yet not interfere with a prompt device 12 response to user button 64 activity. Under the present invention, the execution time dE is substantially less than human perception. Accordingly, should any interrupt occur during the fixed execution program segment 101*a* of FIG. 4, the user is unable to detect any delay in device response to button 64 activity. By collecting the local time of day data automatically in response to the flag detect signal 60 and comparing this local time of day to the time of day information in the packet associated with the detected flag, device 12 has an error factor which may be later and more conveniently used to modify the time of day representation of ripple counter 72. In this manner, a lengthy, i.e., greater than human perception, time period need not be spent with interrupts disabled even though the total processing time required to update time of day is on the order of hundreds of milliseconds.

Overall, the process of receiving a common external time of day reference and updating the local time of day representation, i.e., ripple counter 72, does not interfere with other processing tasks performed by microprocessor 50. In particular, although the programming segment 88 is long compared to human perception, the programming segment 101*a* is short compared to human perception. This allows processor 50 to disable interrupts as is necessary to complete the time of day update procedure.

Thus, an improved method and apparatus for time maintenance and display has been shown and described. In accordance with the first embodiment of FIG. 4, a time of day reference is collected and concurrently therewith a local time of day reference is collected for later comparison with the external standard. A magnitude of error is calculated subsequently along with any other procedures of indeterminate execution time, e.g., procedures associated with message processing, user interface activity, or time display update activity. At a later time when interrupts may be safely disabled for a brief period, the microprocessor 50 executes a brief, guaranteed fixed execution time programming segment to collect the then current local representation of time, i.e., the variable LOCAL_TOD_2, and offset this representation by the detected magnitude of error, i.e., the variable dT, with an accounting for the fixed execution time of the update programming segment 101*a*, i.e., the constant dE. As a result, device 12 maintains consistent and prompt interaction with the user thereof while orchestrating such other high priority tasks such as message processing, time slot targeting, and user interaction.

The above described algorithm of FIG. 4 suffers certain complexity, however, if the calculated result for variable dT involves an offset relative to the seconds, minutes, and hours of microprocessor 50 internal registers 50*a*. The magnitude of error variable dT should be substantially less than one second. However, depending on the actual magnitude of error and its sign relative to the current time of day maintained by device 12, significant additional calculations may be required.

Figure 5:
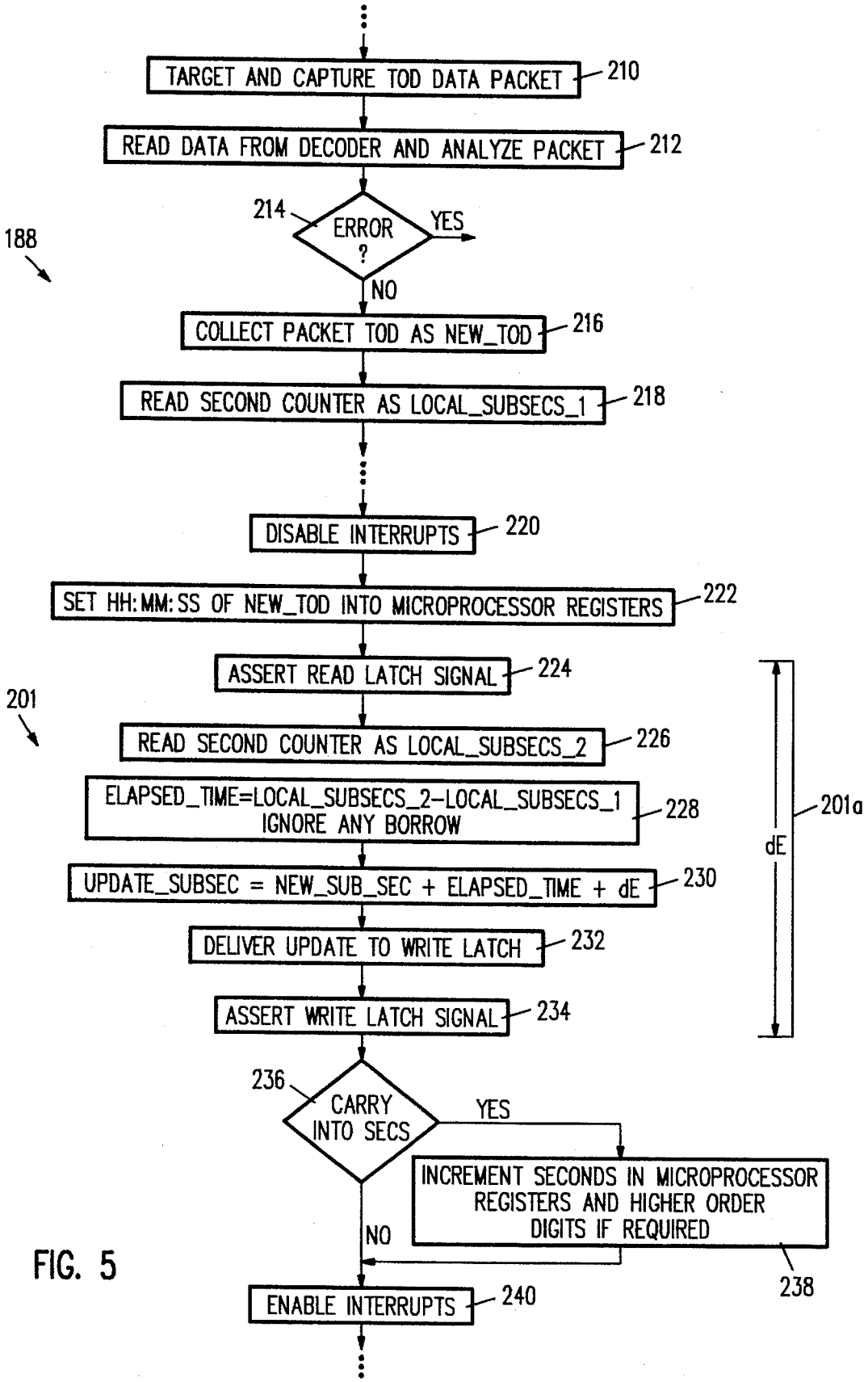
FIG. 5 is a flow chart similar to FIG. 4, but illustrating an alternate method of operation of the processor element of FIG. 3 in implementation of the present invention.

FIG. 5 illustrates an alternative programming arrangement for microprocessor 50 having less complexity and computational overhead, but requires that the microprocessor 50 begin execution of the protected code segment, i.e., with interrupts disabled, within a given time frame relative to assertion of the flag detect signal 60. The algorithm can be more simple under such restriction, with the addition or subtraction of only four binary coded decimal (BCD) digits needed in offsetting the content of ripple counter 72. Modification to internal registers 50*a* can be limited to a simple increment procedure, if needed, similar to that executed in response to one second signal 70. Generally, the algorithm of FIG. 5 calculates a new value for the device 12 local time of day and asserts this value into counter 72 whereas the algorithm of FIG. 4 calculates an error as a basis for offsetting the content of counter 72.

In FIG. 5, two separate programming segments 188 and 201 are illustrated. Programming segment 188 corresponds generally to segment 88 of FIG. 4 and programming segment 201 corresponds generally to programming segment 101 of FIG. 4

In block 210, device 12 targets and captures a time of day data packet 34*a*. In block 212, the captured time of day data packet is provided to microprocessor 50 as the packet data 58. Assuming no detected errors in the collected packet are found in decision block 214, processing advances to block 216 where microprocessor 50 extracts from the received time of day packet 34*a* the current time of day as the variable NEW_TOD. In block 218, microprocessor 50 collects TOD_READ data 84 as the variable LOCAL_SUBSECS_1. As may be appreciated, the value read from the second counter 62 in block 218 represents the content of the ripple counter 72 at the time of flag detect signal 60, and thereby represents the content of ripple counter 72 in relation to the captured of the time of day packet 34*a*. Thus, programming segment 188 includes collection of a new time of day data packet 34*a* and includes capture of the ripple counter 72 content in relation to the corresponding flag detect signal 60.

Continuing to programming segment 201, microprocessor 50 first disables interrupts in block 220. In block 222, microprocessor 50 sets the internal registers 50*a* according to the variable NEW_TOD, i.e., to assert therein the collected hours, minutes, and seconds from the time of day packet 34*a*. In block 224, a protected, fixed execution time programming sub-segment 201*a* begins when microprocessor 50 asserts the read latch signal 79. In block 226, microprocessor 50 collects the TOD read data 84 and assigns such value to the variable LOCAL_SUBSECS_2. In block 228, microprocessor 50 calculates the variable ELAPSED_TIME as the variable LOCAL_SUBSECS_2 minus the variable LOCAL_SUBSECS_1. In such calculation, microprocessor 50 ignores any borrow condition which may result therefrom, i.e., need not update any higher order seconds, minutes, or hours variables since elapsed time is known to be limited. In block 230, microprocessor 50 sums the received fractional second time of day, the elapsed time, and the fixed execution time dE as the variable UPDATE_SUBSEC. More particularly, the variable UPDATE_SUBSEC receives the value of the fractional seconds portion of the received time of day, i.e., the variable NEW_SUB_SEC, plus the content of variable ELAPSED_TIME, plus the fixed execution time constant dE. Microprocessor 50 delivers in block 232 the fractional second portion of variable UPDATE_SUBSEC as the TOD WRITE data 82 to the write latch 76. In block 234, the terminal step in programming sub-segment 201*a*, microprocessor asserts the write latch signal 77 to place the update information into the ripple counter 72.

Certain conditions may give rise to a carry condition into the seconds portion of the local time of day. In decision block 236, microprocessor 50 detects any carry condition into the seconds portion, as generated in block 230, that should be applied to the internal registers 50*a*. If a carry condition exists, i.e., the variable UPDATE_SUBSEC being greater than one second, then processing branches through block 238 where microprocessor 50 increments by one second the registers 50*a* including any modification to higher order digits resulting therefrom such as in response to the second signal 70. Otherwise, processing branches directly from decision block 236 to block 240 where microprocessor 50 enables interrupts.

The algorithm of FIG. 5 substantially reduces computational overhead by reducing calculation to four BCD digits with limited carries, but may occasionally require a one second increment relative to the internal registers 50*a*. The algorithm of FIG. 5 is considered, however, more efficient and less taxing on microprocessor 50 relative to that of FIG. 4.

As noted herein above, the algorithm of FIG. 5 requires that the programming subsegment 201*a* begin execution within a given time relative to the assertion of the flag detect signal 60. In particular, so long as the sum of the variable ELAPSED_TIME and the constant dE is less than one second, then the variable UPDATE_SUBSEC will be less than two seconds. Accordingly, the resulting programming steps require at most a single one second increment to the internal registers 50, i.e., as represented in block 238 of FIG. 5. If execution of programming sub-segment 201*a* cannot be guaranteed to complete execution within the abovenoted time frame, additional increment steps may be employed. For example, if the sum of the variable ELAPSED_TIME and the constant dE may be guaranteed to be less than two seconds, then at most two increment steps need be applied to registers 50*a*. As may be appreciated, under such arrangement additional decision blocks would determine the magnitude of the whole second portion of variable UPDATE_SUBSEC and apply a corresponding number of one second increments to the internal registers 50*a*. If the sum of variable ELAPSED_TIME and constant dE cannot be guaranteed to be less than two seconds, an alternate arrangement should be considered, e.g., that of FIG. 4, due to the additional complexity and execution time required during a time when interrupts are disabled. More particularly, if the time during which interrupts are disabled becomes too long, the user may perceive delay or inconsistent response by the device 12.

It will be appreciated, that the present invention is not restricted to the particular embodiment or embodiments that have been described and illustrated herein, and that variations may be made therein without departing from the scope of the invention as found in the appended claims and equivalents thereof.

I claim:

1. A time keeping and display system comprising:

a time of day broadcast device providing a time of day reference; and a time keeping and display device receiving intermittently said time of day reference and including a time keeping element maintaining time of day and driving a time of day display, a latch capturing a time of day value from said time keeping element in response to said time keeping and display device receiving said time of day reference, and a processing element calculating a time of day update as a function of said captured time of day value and said time of day reference, said processing element modifying said time keeping element as a function of said time of day update during a given execution time procedure.

2. A system according to claim 1 wherein said broadcast device is a radio signal broadcast device and said time keeping and display device includes a radio signal receiving device coupled to said processor element.

3. A system according to claim 1 wherein said time of day update is a time of day error of said time keeping element relative to said time of day reference.

4. A system according to claim 3 wherein said time of day error is applied as an offset to said time keeping element, taking into account said given execution time of said given execution time procedure.

5. A system according to claim 1 wherein said time of day update is a time elapsed since receiving said time of day reference.

6. A system according to claim 5 wherein said time elapsed is summed with said time of day reference and said time keeping element is modified by applying said sum of said time elapsed and said time of day reference to said time keeping element including accounting for said given execution time of said given execution time procedure.

7. A time keeping and display device responsive to an intermittent time of day reference, said device comprising:

a time keeping counter;

a latch coupled to said counter and capturing the content of said counter in response to a latch signal;

a time of day reference collection device providing said latch signal in response to collection of said time of day reference; and a processing element comparing the content of said latch and said time of day reference to calculate a time of day update and executing a given execution time procedure modifying said counter content as a function of said calculated time of day update.

8. A system according to claim 7 wherein said time of day update is a time of day error of said time keeping element relative to said time of day reference.

9. A system according to claim 8 wherein said time of day error is applied as an offset to said time keeping element, taking into account said given execution time of said given execution time procedure.

10. A system according to claim 7 wherein said time of day update is a time elapsed since receiving said time of day reference.

11. A system according to claim 10 wherein said time elapsed is added to said time of day reference and said time keeping element is modified by applying said sum of said time elapsed and said time of day reference to said time keeping element including a counting for said given execution time of said given execution time procedure.

12. A device according to claim 7 further comprising a second latch receiving its content from said processor element and delivering its content in response to a second latch signal whereby said processor element calculates a new time of day value for said counter as a function of said time of day update and loads said new time of day value during said given execution time procedure.

* * * * *